US007007614B2

(12) United States Patent
Gaunt et al.

(10) Patent No.: US 7,007,614 B2
(45) Date of Patent: Mar. 7, 2006

(54) EXPANDABLE SHELF

(75) Inventors: Bruce William Gaunt, Albertville, MN (US); Thomas August Harrop, McHenry, IL (US); Michael Lee Pyle, Cambridge, WI (US)

(73) Assignee: Rubbermaid Incorporated, Wooster, OH (US)

( * ) Notice: Subject to any disclaimer, the term of this patent is extended or adjusted under 35 U.S.C. 154(b) by 63 days.

(21) Appl. No.: 10/438,706

(22) Filed: May 15, 2003

(65) Prior Publication Data

US 2003/0226815 A1 Dec. 11, 2003

Related U.S. Application Data

(60) Provisional application No. 60/384,594, filed on May 31, 2002.

(51) Int. Cl.
*A47B 11/80* (2006.01)

(52) U.S. Cl. ..... 108/102; 248/346.07

(58) Field of Classification Search ..... 248/346.07, 248/292.12; 211/90.02, 153; 312/351, 205; 108/65, 64, 137, 102, 143
See application file for complete search history.

(56) References Cited

U.S. PATENT DOCUMENTS

| | | | | | |
|---|---|---|---|---|---|
| 1,770,250 | A | * | 7/1930 | Norton | 16/56 |
| 2,386,702 | A | * | 10/1945 | McBride | 105/282.3 |
| 2,506,970 | A | * | 5/1950 | Milton | 99/581 |
| 4,279,553 | A | * | 7/1981 | Cleary | 408/135 |
| 4,500,146 | A | | 2/1985 | Peterson | |
| 4,808,875 | A | | 2/1989 | Edwards | |
| 5,137,160 | A | | 8/1992 | Santucci | |
| D329,157 | S | * | 9/1992 | Santucci | D6/511 |
| 5,221,013 | A | | 6/1993 | Santucci | |
| 5,415,472 | A | | 5/1995 | Brise | |
| 5,421,646 | A | | 6/1995 | McNamara et al. | |
| 5,474,192 | A | | 12/1995 | Hartzell | |
| 5,658,058 | A | * | 8/1997 | Bivens et al. | 312/331 |
| 5,671,990 | A | | 9/1997 | Teasdale | |
| 5,909,935 | A | * | 6/1999 | Esperandieu et al. | 312/333 |
| 5,918,550 | A | * | 7/1999 | Weir et al. | 108/42 |
| 5,947,036 | A | * | 9/1999 | Cohen | 108/110 |
| 6,073,901 | A | * | 6/2000 | Richter | 248/316.4 |
| 2004/0164655 | A1 | * | 8/2004 | Wood et al. | 312/205 |

* cited by examiner

*Primary Examiner*—Jose V. Chen
(74) *Attorney, Agent, or Firm*—Marshall, Gerstein & Borun LLP

(57) ABSTRACT

An expandable locker shelf is disclosed that can be placed between two substantially vertical members, such as in a locker. The expandable shelf includes a first section having a rack, a second section, and a lever arm having a pinion. The first and second sections are aligned to engage the pinion with the rack. The lever arm enables the user to provide sufficient torque on the pinion to bias the first and second sections between the two substantially vertical members. The expandable locker shelf is locked between the two substantially vertical walls by engaging the lever arm with a retaining post.

22 Claims, 5 Drawing Sheets

EXPANDABLE SHELF

RELATED APPLICATION DATA

The present application is a non-provisional application based on co-pending provisional application No. 60/384,594 which was filed on May 31, 2002.

FIELD OF THE DISCLOSURE

The present invention generally relates to an expandable shelf and, more particularly, to an expandable shelf adapted to fit between two substantially vertical walls, such as within a locker.

BACKGROUND OF THE DISCLOSURE

Lockers are used in many situations for a great variety of reasons. Students, for example, use lockers to store books, jackets, food, and the like, while at school, and workers often have lockers at their place of employment, to either store their work clothes, or perhaps to store personal items during work. Lockers can, however, be found in many other places, including fitness gyms, locker-rooms or any other place where a person may require temporary storage. The average locker is generally tall enough to allow the user to the hang a coat or jacket onto one or more provided hooks, and is generally wide enough to allow the user to place a pair of shoes or several books within the locker. In some lockers, a shelf has been added near the top of the locker, usually above the hooks, to provide for additional surface area on which for the user may place items.

Lockers, however, are usually very narrow, and even with the addition of a shelf the user has very limited surface area on which to place items. A high school student, for example, may on any given day bring a lunch, several books, a coat, a gym bag, and writing utensils to school, all of which need to be stored in the locker. With the limited amount of space, the coat may be placed on a hook, the gym bag placed on the floor of the locker, the books placed on a shelf (if provided), and the remainder of the items will be placed on top of each other, possibly breaking, crushing, or otherwise damaging one or more of the items. If the items are not damaged, the user will have a difficult time getting access to some of the items without having to move one or more items out of the way.

Several devices have been created to add more surface area, and hence more available storage space to the inside of lockers. These devices, however, have resulted in shelves that either have not fully solved the problem, are difficult to use, and/or create new problems. One device, for example, disclosed in U.S. Pat. No. 5,671,990 includes a shelf that is hung from a plurality of hooks within the locker. The hung shelf creates additional surface area within the locker, but also prevents the hooks from being used to hold other items such as coats and jackets. Another device disclosed in U.S. Pat. No. 4,500,146 includes four vertical poles and a set of shelves, wherein the vertical poles are placed in the four corners of the locker and the shelves are attached to the vertical poles via a series of holes located on the vertical poles. There are several problems with this device, including that it is difficult to move into and out of the locker, that the vertical poles further limit the available space, and that the shelves are restricted in their vertical placement to the height of the four poles.

There are also two-piece and three-piece shelf devices that have attempted to add surface area inside a locker. A two-piece locking shelf device disclosed in U.S. Pat. No. 5,221,013 includes two-shelf like sections that lock into each other thereby creating in combination a hinge type mechanism. The two sections are engaged and folded prior to placement in the locker and are then wedged between the locker walls by unfolding the sections inside the locker. This design is difficult to install, however, and the lack of an adjustment mechanism, once in the locker, may not allow the device to fit into every locker.

U.S. Pat. No. 5,421,646 discloses a three-piece ratcheting shelf device includes two ratcheting shelf sections and a cam, whereby the cam moves the two sections relative to each other, which are then locked into place by a set of ratcheting teeth. In this device, however, it is difficult to get enough torque on the cam to properly tighten the device between the locker walls, and once installed, it is difficult to remove the shelf because one or more small tabs have to be pressed to release the ratcheting shelves from each other.

SUMMARY OF THE DISCLOSURE

In accordance with one aspect of the disclosure, an expandable locker shelf having a first section, a second section, and an elongate lever arm is disclosed. The first section may include a rack that slidingly engages with the second section and the second section may include a first pivot portion. The elongate lever arm may include a first end having a second pivot portion that engages with the first pivot portion, thereby pivotally attaching the lever arm to the second section, and a pinion that engages with the rack, thereby causing movement of the first and second sections relative to each other.

Figure 1:
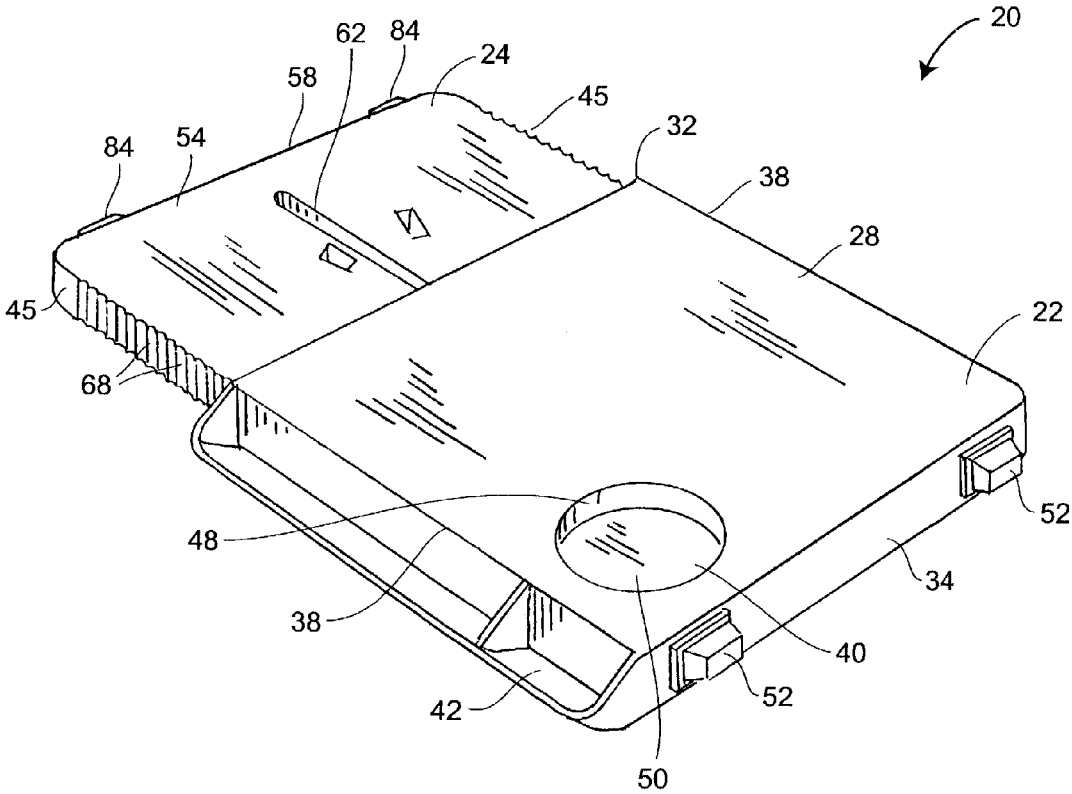
FIG. 1 is a top perspective view of an expandable locker shelf in accordance with the teachings of the present disclosure.

While the method and device described herein are susceptible to various modifications and alternative constructions, certain illustrative embodiments thereof has been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention and the appended claims.

DETAILED DESCRIPTION

Figure 2:
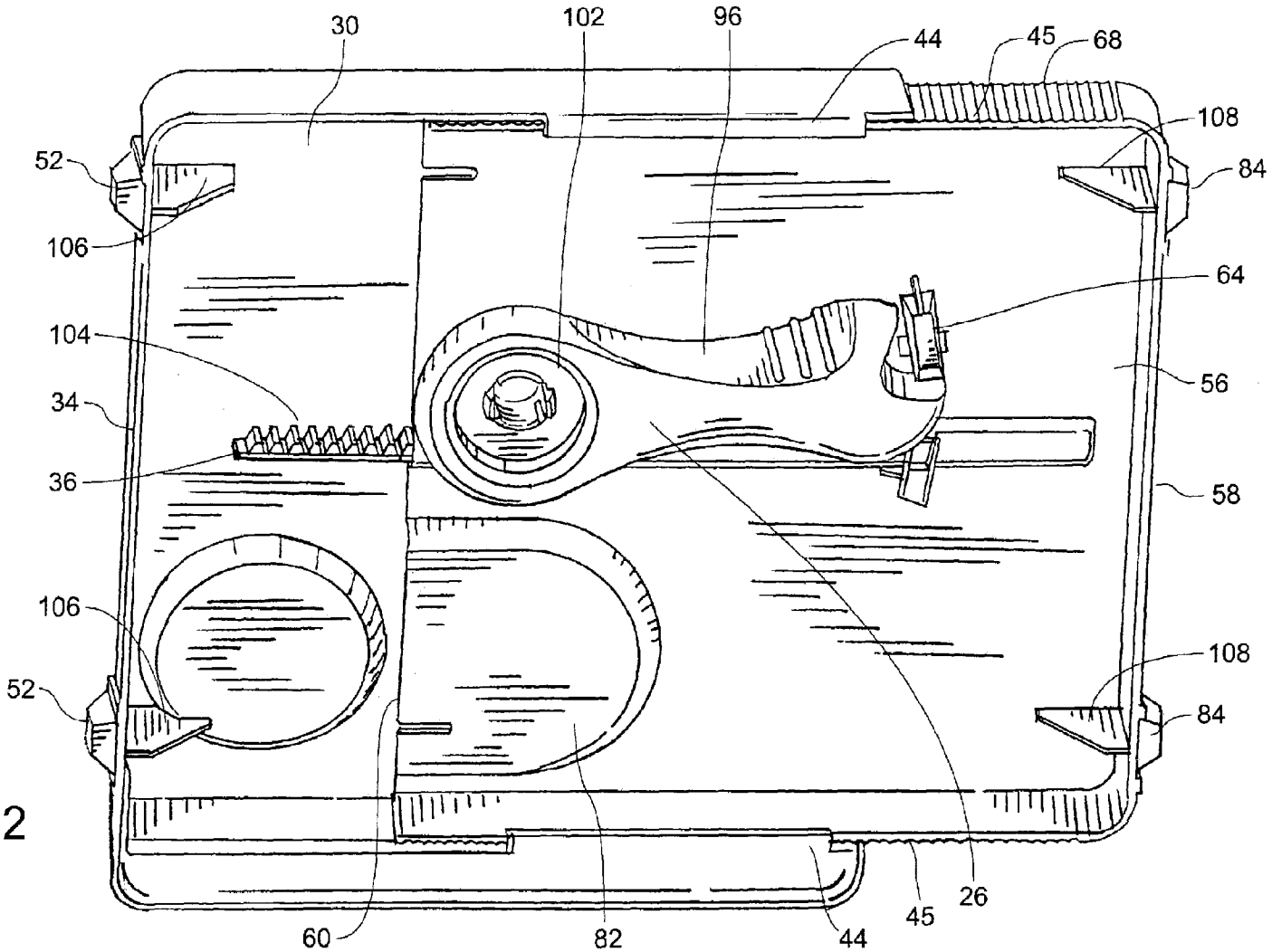
FIG. 2 is a bottom perspective view of the expandable locker shelf.

Referring now to the drawings, and with specific reference to FIGS. 1 and 2, an expandable locker shelf constructed in accordance with the teachings of the disclosure is generally depicted by reference numeral 20. As shown therein, the expandable locker shelf 20 includes a first section 22, a second section 24, and a lever arm 26.

The expandable locker shelf 20 may be fabricated from relatively light weight, durable, and sturdy plastic materials such as polyethylene, polypropylene, polystyrene, polycarbonate, or other suitable materials such as metal, wood, etc. The process or processes used to form the various components of the expandable locker shelf 20 can also vary considerably as necessary to form each given component. The expandable locker shelf 20 may be injection molded, blow molded, continuously molded, extruded, vacuum formed, rotation molded, or the like. The manufacturing process or processes may be selected based on feasibility, cost, tooling concerns, as well as other factors for a given application.

In this exemplary embodiment, the first section 22 includes an upper side 28, a lower side 30, an inside edge 32, an outer wall 34, and a rack 36. This first section 22 may also include one or more side walls 38, a cup holder 40, a pen holder 42, and/or one or more alignment members 44. The first section 22 has a generally square shape, but could be any other shape such as rectangular, round, oval, or odd-shaped, so long as the shape of the first section 22 and the second section 24 of the expandable locker shelf 20 combine to create an expandable locker shelf able to be used in a locker 46 or any other device having two substantially vertical walls.

Figure 3:
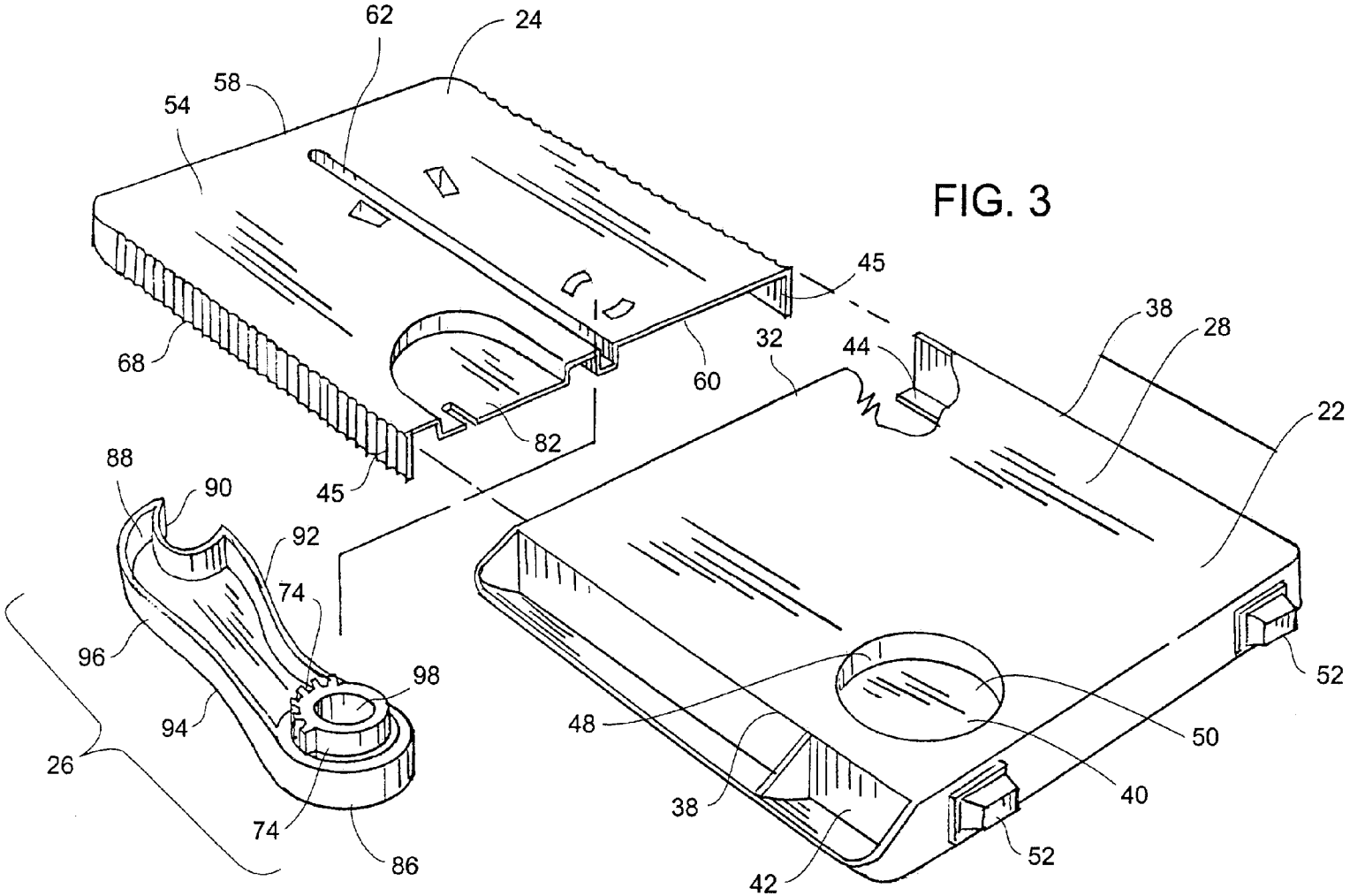
FIG. 3 is an exploded top perspective view of the expandable locker shelf of FIG. 1.
Figure 4:
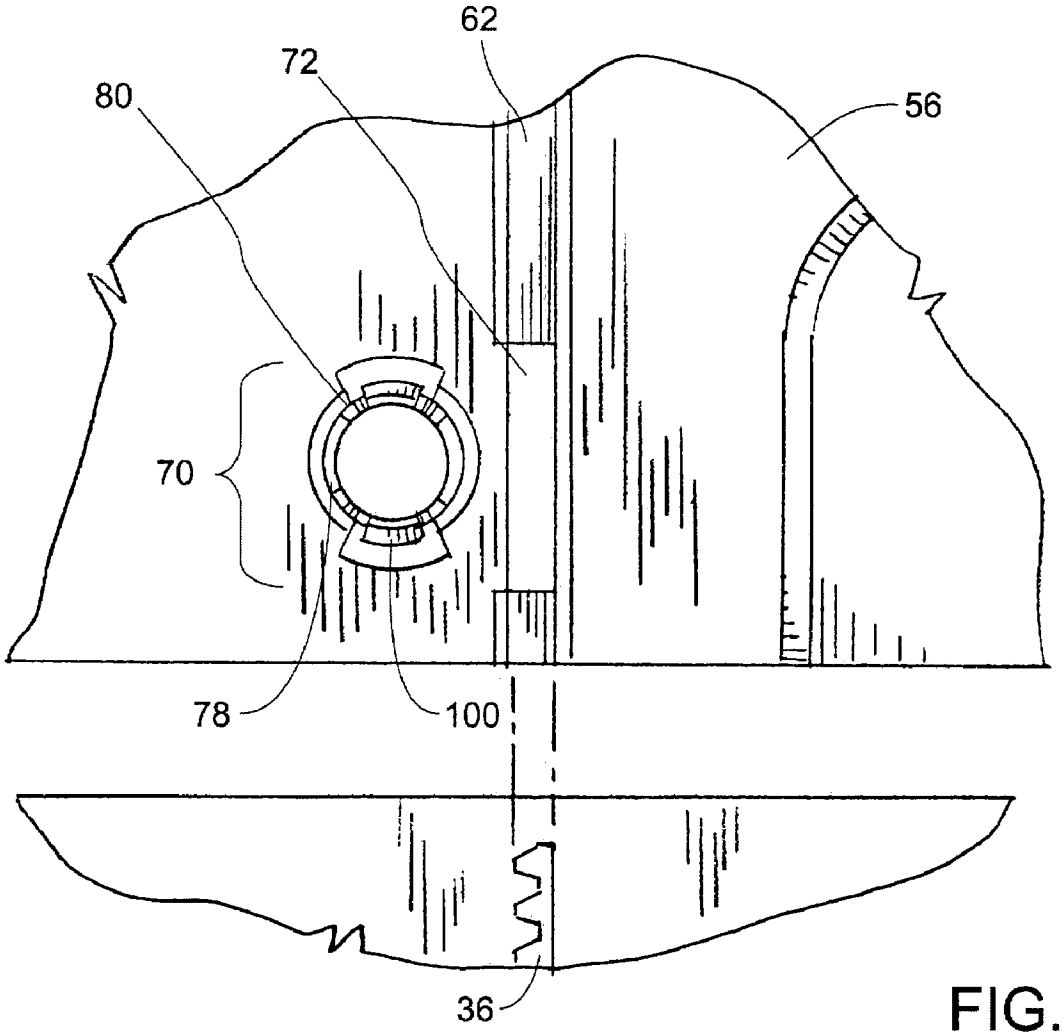
FIG. 4 is a bottom view of the expandable shelf of FIG. 1, detailing a rack channel, a gap, and a lever arm adaptor.

Located to the right of and substantially perpendicular to the upper side 28 (as shown in FIGS. 1 and 3) is the outer wall 34. Located to the front and rear and substantially perpendicular the upper side 28 may be the side walls 38. Opposite the outer wall 34 on the first section 22 is the inside edge 32. The outer wall 34 and side walls 38 may protrude downwardly from the lower side 30 on the respective ends of the first section 22, thereby creating on the lower side 30 an area having containment on three of four sides. Located on the lower side 30 of the first section 22 is the rack 36. The rack 36, in this embodiment, is centered between the sidewalls 38 on the lower side 30 and is oriented such that the length of the rack 36 runs perpendicular to the outer wall 34 and parallel to the side walls 38.

The alignment members 44, as mentioned above, may be part of the first section 22, but may also be part of the second section 24, or may be a wholly separate device adapted to connect and/or engage the first and second sections 22, 24. The one or more alignment members 44, in this embodiment, are located on the side walls 38 of the first section 22, in the form of a pair of elongate tabs 44, and are adapted to engage with the one or more side walls 45 of the second section 24. More specifically, the first and second sections 22, 24 may be slidingly engaged, and may be aligned relative to each other by positioning the side walls 45 of the second section 24 into an area between the elongate tabs 44 and the lower side 30 of the first section 22. The area between the elongate tabs 44 and the lower side 30 of the first section 22 may be slightly larger than the width of the side walls 45 of the second section 24 to allow a proper fit whereby the first and second sections 22, 24 are able to slide and be aligned relative to each other.

In one exemplary embodiment, a pen holder 42 is located to the front of the first section 22, and can receive a variety of supplies, including, but not limited to, pens, pencils, paperclips, erasers, rubber bands, money, etc. The pen holder 42 may be an integral part of the first section 22, or may be manufactured separately and then connected to the first section 22 via any number of connection methods. The cup holder 40 may be located on the upper side 28 of the first section 22, and may receive a bottom portion of a cup. The cup holder 40, in this embodiment, is a detent on the upper side 28 of the first section 22, having a generally cylindrical wall 48 and a circular bottom 50. The user may place any number of items into the cup holder 40, including, but not limited to, a cup, a bottle, a can, a glass, etc.

One or more friction pads 52 may be located on the exterior of the outer wall 34. The friction pads 52 can be an integral part of the first section 22, or may be manufactured separately from the first section 22 and then be attached via any number of connection methods. In this embodiment, the friction pads 52 are manufactured from a rubber-like substance such as thermoplastic elastomers or silicon, and are attached to the first section 22 with an adhesive.

In one exemplary embodiment, the second section 24 of the expandable locker shelf 20 (best seen in FIGS. 1–3) includes an upper side 54, a lower side 56, an outer wall 58, an inside edge 60, a rack channel 62, and one or more retaining posts 64. The second section 24 may also include one or more side walls 45, on or more progress indicators 68, and a lever arm adaptor 70. The second section 24, like the first section 22, has a generally square shape, but could be any other shape such as rectangular, round, oval, or odd-shaped. Located to the left of and substantially perpendicular to the upper side 54 (as shown in FIGS. 1 and 3), is the outer wall 58.

Located to the front and rear of the second section 24, and substantially perpendicular to the upper side 54 may be the side walls 45. Opposite the outer wall 58 of the second section 24 is the inside edge 60. The outer wall 58 and side walls 45 may protrude downward from the lower side 56 on the respective ends of the second section 24, thereby creating on the lower side 56 an area having containment on three of four sides. On the outside of the side walls 45 of the second section 24 can be the one or more progress indicators 68. The progress indicators 68, in this embodiment, can be a set of ridges running perpendicular to the length of the side walls 45 that are adapted to engage with at least a portion of the side walls 38 of the first section 22.

The progress indicators 68 may create a ratchet type noise as well as a visual and tactile indication of movement during the operation of the expandable shelf 20 to indicate to the user that the first and second sections 22, 24 are moving relative to each other.

The rack channel 62 is located on the upper side 54 of the second section 24, and is adapted to receive the rack 36. The rack channel 62, in this embodiment, is centered between the side walls 45 and is oriented such that the length of the rack channel 62 runs perpendicular to the outer wall 58 and parallel to the side walls 45. The width, depth and length of the rack channel 62 may be dictated by the width, depth and length of the rack 36. In this embodiment, the rack channel 62 and hence the rack 36, run along the majority of the length of the first and second sections 22, 24. More specifically, the rack channel 62 and the rack 36 may extend from the inside edges 32, 60 of the first and second sections 22, 24 respectively, to almost the outer walls 34, 58, of the first and second sections 22, 24, respectively. Toward the inside edge 60 of the second section 24, the rack channel 62 can include a gap 72. The gap 72 on the rack channel 62 can be located on the side of the rack channel 62 facing the lever arm adaptor 70, and can be long enough to allow for proper engagement of the rack 36 and a pinion 74 (best seen in FIG. 3) on the lever arm 26, when the expandable shelf 20 is in operation.

The lever arm adaptor 70 may be located on the lower side 56 of the second section 24, may be adapted to receive the lever arm 26, and may be located a sufficient distance away from the rack channel 62 to allow for proper engagement of the rack 36 and the pinion 74 during operation of the expandable shelf 20. The lever arm adaptor 70, in this embodiment, includes an alignment ring 78 and one or more retention tabs 80. The one or more retaining posts 64 may be located a radial distance from the lever arm adaptor 70, on the lower side 56 of the second section 24. A recessed area 82, adapted to provide clearance for the cup holder 40, may be located on the upper side 54 of the second section 24.

One or more friction pads 84 may be located on the exterior of the outer wall 58. The friction pads 84 may be an integral part of the second section 24, or may be manufactured separately from the second section 24 and may be attached to the second section 24 via any number of connection methods. In this embodiment, the friction pads 84 are manufactured from a rubber-like substance such as thermoplastic elastomers or silicon, and are attached to the second section 24 with an adhesive.

The lever arm 26 may be rotatably attached to the lower side 56 of the second section 24, via the lever arm adaptor 70. The lever arm 26, in this embodiment, includes a pivot end 86, a locking end 88, a notch 90, a first side 92, a second side 94, a handle portion 96, the pinion 74, and a coupling portion 98. The coupling portion 98, in this embodiment, is a cylindrical aperture located at the center of both the pinion 74 and the pivot end 86 of the lever arm 26, and is adapted to engage with the lever arm adaptor 70. More specifically, the coupling portion 98 may engage with the lever arm adaptor 70, such that the outer surface of the retention tabs 80 of the lever arm adaptor 70 abut the inner surface of the coupling portion 98. To keep the coupling portion 98 and the lever arm adaptor 70 engaged, a pair of ledges 100 on the ends of the retention tabs 80 may abut an inner coupling surface 102, thereby connectively engaging the lever arm 26 and the lever arm adaptor 70.

The pinion 74, located on the first side 92 of the lever arm 26, is at least a partial pinion that includes a plurality of pinion teeth 104 located about the circumference of the pinion 74. The pinion 74, and specifically the pinion teeth 104, may be adapted to engage with the rack 36 during operation of the expandable shelf 20. When the lever arm 26 is positioned to disengage the pinion 74 from the rack 36, the lever arm 26 may move freely relative to the rack 36 without any substantive contact between the lever arm 26 and the rack 36. The handle portion 96 may be located between the pivot end 86 and the locking end 88. The handle portion 96, in this embodiment, is ergonomically fashioned to provide a griping area for the user when engaging the lever arm 26 with the rack 36. The notch 90, adapted to engage with the retaining posts 64, may be located on the locking end 88 of the lever arm 26. The lever arm 26 may be elongate to allow the user a substantive amount of leverage for operation of the expandable shelf 20.

In operation, the expandable shelf 20 may be used in any number of places which at a minimum include two substantially vertical side walls or portions between which the expandable shelf 20 may be positioned. To assemble the expandable shelf 20, the user may first press the lever arm 26 onto the lever arm adaptor 70. More specifically, with the first side 92 of the lever arm 26 facing the lower side 56 of the second section 24, the lever arm 26 may be rotatably attached to the second section 24 by pressing the coupling portion 98 of the lever arm 26 onto the lever arm adaptor 70, such that the retention tabs 80 depress toward each other as the lever arm 26 is pressed onto the lever arm adaptor 70, until the outer surface of the retention tabs 80 of the level arm adaptor 70 abut the inner surface of the coupling portion 98 and the ledges 100 on the ends of the retention tabs 80 engage the inner coupling surface 102 of the coupling portion 98 of the lever arm 26. The lever arm 26 can now be rotated, such that the notch 90 on the lever arm 26 can engage with the retaining posts 64, and such that the pinion teeth 104 can rotate into and out of the gap 72 on the rack channel 62, to later engage with the rack 36.

To complete the assembly of the expandable shelf 20, the first and second sections 22, 24 may be aligned via the alignment members 44, thereby also aligning the rack 36 to the rack channel 62. More specifically, the end of the side walls 45 near the inside edge 60 of the second section 24, may be slid into the area between the lower side 30 and the alignment members 44, of the first section 22. To collapse (i.e. minimize the combined size of) the expandable shelf 20, the first and second sections 22, 24 may be pushed into each other until the inside edge 60 of the second section 24 abuts the inside of the outer wall 34 of the first section 22. To enable the full collapse of the expandable shelf 20, without engagement of the lever arm 26 with the rack 36, the lever arm 26 may be disengaged from the rack 36 by rotateably positioning the lever arm 26 to place the portion of the pinion 74 without pinion teeth 104 into the gap 72 of the rack channel 62.

To install the expandable shelf 20 into a locker 46, for instance, the user places the collapsed expandable shelf 20 into the locker 46, such that the upper sides 28, 54 of the first and second sections 22, 24, respectively, face up, and such that the pen holder 42 faces the user. Before expanding the expandable shelf 20, the user may ensure that the pinion 74 of the lever arm 26 is positioned not to engage with the rack 36. In this embodiment, the lever arm 26, now being attached to the lower side 56 of the second section 24, would point away from the user, thereby placing the portion of the pinion 74 without teeth 104 into the gap 72 of the rack channel 62. The user can now expand the expandable shelf 20 by pulling the first and second sections 22, 24 away from each other, until the friction pads 52, 84 located on the outer walls of the first and second sections 22, 24, respectively, abut the respective sides of the locker 46.

Figure 5:
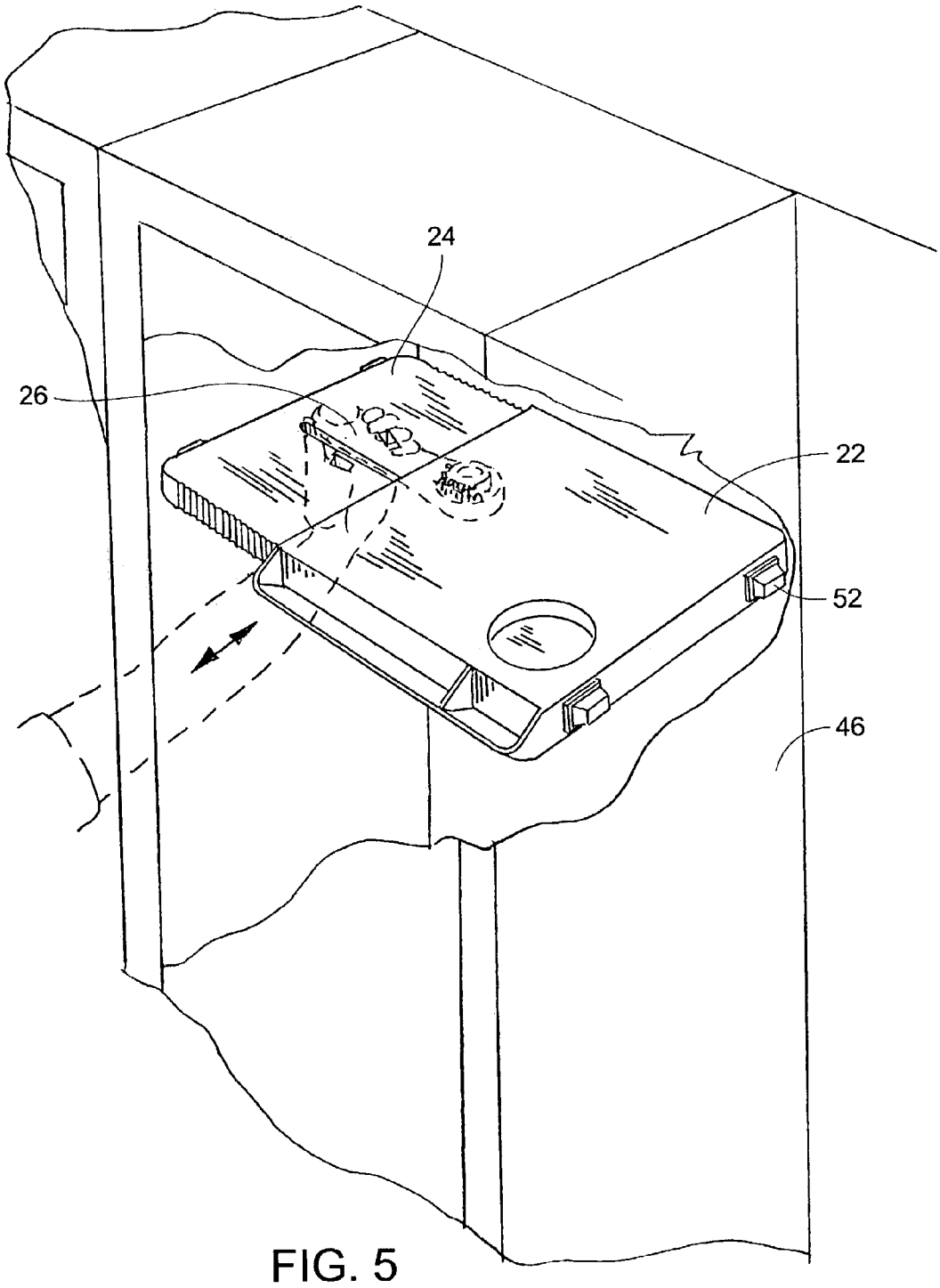
FIG. 5 is a top perspective view of the expandable locker shelf as used in a locker.

The lever arm 26 can now be used to tighten and lock the expandable shelf 20 into the locker 46, by rotating the lever arm 26 counter clockwise (as viewed looking onto the top of the expandable shelf 20) about the lever arm adaptor 70 (FIG. 5). By rotating the lever arm 26, the pinion teeth 104 will engage with the rack 36 in the gap 72 of the rack channel 62, thereby further expanding the expandable shelf 20. In this embodiment, the lever arm 26 engages the rack 36 with a plurality of pinion teeth 104 at the same instant during operation, thereby allowing the force of the pinion teeth 104 to be distributed throughout greater portions of the rack 36 and creating a longer lasting and more durable rack 36 and pinion teeth 104 engagement.

To properly secure the expandable shelf 20 within the locker 46, a sufficient amount of force must be placed between the expandable shelf 20 and the walls of the locker 46. To create the necessary force, the user, after having engaged the pinion teeth 104 with the rack 36, can continue to expand the expandable shelf 20 by continued rotation of the lever arm 26. Because of the size and length of the lever arm 26, the user can create enough torque on the pinion 74 to temporarily deform, move and/or compress one or more components of the expandable shelf 20 and/or the locker 46. Once the sufficient amount of force has been placed between the expandable shelf 20 and the walls of the locker 46, the expandable shelf 20 can be locked into place by engaging the notch 90 on the lever arm 26 with one of the retaining posts 64. Now that the expandable shelf 20 is locked into place, the user can utilize the expandable shelf 20 to place and/or store items thereon.

To remove the expandable shelf 20 from the locker 46, the user can rotate the lever arm 26 enough to overcome the compression and bias on the expandable shelf 20, and disengage the notch 90 from the retaining post 64. More specifically, in this embodiment, as best illustrated in FIG. 5, the user may pull on the lever arm 26 thereby disengaging the notch 90 from one of the retaining posts 64. Once the notch 90 and the retaining post 64 are disengaged, or once the compression and/or bias on the expandable shelf 20 is overcome, the user may manipulate the lever arm 26 to rotate underneath the retaining post 64 by bending or flexing the lever arm 26 downwardly. Once again, the size and length of the lever arm 26, enables the user to create enough torque on the pinion 74 to allow for enough movement between the first and second sections 22, 24 to disengage the notch 90 from the retaining post 64. Once the notch 90 is disengaged from the retaining post 64, the compression and bias placed on the expandable shelf 20 continues to cause further collapse of the expandable shelf 20 until substantially all of the compression and/or bias has been eliminated. The user may continue to rotate the lever arm 26 until the pinion 74 is no longer engaged with the rack 36, fully collapse the expandable shelf 20, and remove it from the locker 46.

The construction and arrangement of the elements of the expandable shelf 20 and the method as shown herein are only illustrative, and may vary greatly from the disclosed embodiments. Although only one embodiment of the expandable shelf 20 has been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the present invention.

For example, elements shown as integrally formed may be constructed of multiple parts or elements. Similarly, the operation of the interfaces may be reversed or otherwise varied, the length or width of the structures and/or members or connector or other elements of the system may be varied, and/or the nature or number of adjustment positions provided between the elements may be varied. Also, the expandable shelf 20 may have any number of a variety of designs and configurations to work with a variety of lockers. Further, the expandable shelf 20 could also include one or more structural supports, such as supports 106 located on the first section 22 between the lower side 30 and the outer wall 34, and supports 108 located on the second section 24 between the lower side 56 and the outer wall 58.

The elements and/or assemblies of the system may be constructed from any of a wide variety of materials that provide sufficient strength or durability, in any of a wide variety of colors, textures and combinations. Accordingly, the foregoing detailed description has been given for clearness of understanding only and no unnecessary limitations should be understood therefrom, as modifications will be apparent to those skilled in the art.

What is claimed is:

1. An expandable shelf comprising:

a first section including a rack;

a second section including a first pivot portion, wherein the second section slidingly engages the first section; and a pinion including an outer surface having a first outer surface area that includes a plurality of teeth for engaging the rack and a second outer surface area that is toothless, wherein the pinion rotates about the first pivot portion and engages the rack, thereby moving the first and second sections relative to each other.

2. The expandable shelf of claim 1, further including an alignment portion for aligning the first and second sections during operation.

3. The expandable shelf of claim 1, further including a plurality of friction pads located on outer walls of the first and second sections.

4. The expandable shelf of claim 1, further including a storage bin.

5. The expandable shelf of claim 1, further including a cup holder.

6. The expandable shelf of claim 1, further including a progress indicator.

7. The expandable shelf of claim 6, wherein the progress indicator includes a plurality of ridges.

8. The expandable shelf of claim 1, wherein the pinion has teeth on only a minority of the pinion.

9. The expandable shelf of claim 1, wherein the pinion is part of a lever arm.

10. The expandable shelf of claim 1, wherein the shelf is constructed from one of a polyethylene, polypropylene, polystyrene, and polycarbonate material.

11. An expandable shelf comprising:

a first section including a rack;

a second section including a first pivot portion, wherein the second section slidingly engages the first section;

a locking mechanism including a first and a second locking portion, the first locking portion being disposed on one of the first and second sections; and an elongate lever arm having a first end including a pinion and a second pivot portion, wherein the second pivot portion engages with the first pivot portion thereby pivotally attaching the lever arm to the second section, and a second end including the second locking portion, wherein the second locking portion engages with the first locking portion.

12. The expandable shelf of claim 11, further including an alignment portion for aligning the first and second sections during operation.

13. The expandable shelf of claim 11, further including a plurality of friction pads located on outer walls of the first and second sections.

14. The expandable shelf of claim 11, further including a storage bin.

15. The expandable shelf of claim 11, further including a cup holder.

16. The expandable shelf of claim 11, further including a progress indicator.

17. The expandable shelf of claim 16, wherein the progress indicator includes a plurality of ridges.

18. The expandable shelf of claim 11, wherein the pinion has teeth on only a minority of the pinion.

19. The expandable shelf of claim 11, wherein the lever arm includes an ergonomic handle.

20. The expandable shelf of claim 11, wherein the shelf is constructed from one of a polyethylene, polypropylene, polystyrene, and polycarbonate material.

21. An expandable shelf comprising:

a first section including a rack;

a second section adapted to slidingly engage the first section; and an elongate lever arm having a first end and a second end, the lever arm being rotatably attached to the second section, wherein the first end includes a pinion having a plurality of teeth that engage the rack during operation, and the second end includes first locking portion that engages with a second locking portion located on the expandable shelf for locking the shelf in an expanded position.

22. A method of installing an expandable shelf comprising:

placing the expandable shelf having a first and second section between two substantially vertical walls;

engaging a pinion rotatably mounted on the first section with a rack located on the second section;

rotating a lever arm attached to the pinion, thereby moving the first and second sections relative to each other; and placing a notch located on the lever arm on a retaining post, thereby locking the expandable shelf between the substantially vertical walls.

* * * * *